United States Patent [19]

Fujimatsu

[11] 4,205,037

[45] May 27, 1980

[54] PROCESS FOR PRODUCING ACRYLIC SYNTHETIC FIBERS HAVING ANTI-PILLING PROPERTIES

[75] Inventor: Masaaki Fujimatsu, Okayama, Japan

[73] Assignee: Japan Exlan Company Limited, Osaka, Japan

[21] Appl. No.: 953,535

[22] Filed: Oct. 23, 1978

[30] Foreign Application Priority Data

Nov. 16, 1977 [JP] Japan ..... 52-138219

[51] Int. Cl.[2] ..... D01D 5/10

[52] U.S. Cl. ..... 264/182; 264/210.5; 264/210.7; 264/210.8

[58] Field of Search ..... 264/182, 210 F, 210.5, 264/210.7, 210.8, 182

[56] References Cited

U.S. PATENT DOCUMENTS 3,485,913 12/1969 Yamada et al. ..... 264/168

FOREIGN PATENT DOCUMENTS 48-35121 5/1973 Japan ..... 264/182
49-80323 8/1974 Japan ..... 264/182
49-124335 11/1974 Japan ..... 264/182

*Primary Examiner*—Jay H. Woo
*Attorney, Agent, or Firm*—Wenderoth, Lind & Ponack

[57] ABSTRACT

Acrylic synthetic fibers highly resistant to pilling and having good dyeability can be produced by specifying the composition of the acrylic polymer, the condition of the primary stretching step, the internal water content of the water-swollen gel fibers, the conditions of the steps of the drying-compacting, secondary stretching and relaxing heat treatment.

5 Claims, 1 Drawing Figure

PROCESS FOR PRODUCING ACRYLIC SYNTHETIC FIBERS HAVING ANTI-PILLING PROPERTIES

BACKGROUND OF THE INVENTION

1. Field of the Invention

The present invention relates to a process for producing acrylic synthetic fibers having anti-pilling properties, and more specifically to a process for producing acrylic synthetic fibers highly resistant to pilling, and with respect to dyeability, not inferior to conventional ones, in which process the condition of the primary stretching (the general term of the cold stretching immediately after spinning and the hot stretching given subsequently to the water-washing after the cold stretching), the internal water content of the water-swollen gel fibers, the conditions of the steps of drying-compacting, secondary stretching and relaxing heat treatment are specified.

2. Description of the Prior Art

It is well known that acrylic synthetic fibers have a wide field of applications in textile materials and room furnishing materials because of their wool-like soft hand and excellent dyeability.

However, it is not that such acrylic synthetic fibers excellent in usefulness have no defect in practical use, and in effect in certain fields of their applications it has been strongly demanded to establish quickly industrial means for improving fiber properties.

Although the resistance to abrasion and resistance to fibrillation of acrylic synthetic fibers can almost satisfy the practical level demanded for textile materials, etc., woven or knitted fabrics produced from acrylic synthetic fibers have a defect that small balls of entangled short fibers, the so-called "pills," are generated on the surface of the fabrics with the passage of wearing time and greatly lower the commercial value.

The generation of such pills is not a problem peculiar to acrylic synthetic fibers, but is a trouble in practical use widely observed also in polyamide fibers or polyester fibers. The generation of pills in woven or knitted fabrics obtained from acrylic synthetic fibers can be said rather less in comparison with the case of polyamide fibers or polyester fibers, but even then considerable formation of pills is observed as compared with woven or knitted fabrics obtained from wool fibers. This has been a cause that acrylic synthetic fibers cannot be satisfactorily substituted for wool fibers as a fabric-forming material.

Therefore, to prevent such generation of pills, several industrial means have been heretofore employed. It is described, for example, in Japanese Patent Publication No. 5863/1973, that the resistance to pilling of acrylic synthetic fibers can be grasped as a correlation of single-filament denier and strength characteristics, and in Japanese Patent Publication No. 18195/1964, that in order to impart resistance to pilling to woven fabrics made from acrylic synthetic fibers, the fabrics are treated with an aqueous solution of aniline, aniline acetate, aniline hydrochloride, or aniline sulfate.

However, in practice, the former uses acrylic synthetic fibers of considerably large single-filament deniers and therefore if the fibers are used as a material for forming carpets, a certain degree of usefulness can be acknowledged but no substantial applicability was observed for purposes as general textile-forming material.

The latter process poses a fundamental question as to its usefulness in respect to odor and coloring.

Recently, Japanese Patent Application Laid-Open Nos. 80323/1974 and 35121/1973 propose processes for producing anti-pilling acrylic synthetic fibers which are lowered in fiber properties, especially in elongation. These processes also involve unsolved problems. For example, because of too high a content of acrylonitrile, which is the acrylic fiber-forming component, it is impossible to obtain dyed products which can ensure a satisfactory level of deep color. Therefore, the practice on an industrial scale remains as a problem.

Thus, although technical means have been attempted to obtain anti-pilling fibers by modifying the production condition of acrylic synthetic fibers, it has been extremely difficult to obtain a favorable balance of single-filament strength, elongation and fiber dyeability at the same time.

STATEMENT OF THE INVENTION

In the light of such circumstances, we researched to find an industrial means which will eliminate all the various restrictions attendant on the conventional techniques as mentioned above and will impart remarkably improved anti-pilling properties to the final fibers, without lowering the dyeability of acrylic synthetic fibers. As a result, we have found that the objects of the present invention are advantageously attained by employing an acrylic polymer of a prescribed composition, swollen gel fibers having a prescribed water content and post-treatments under prescribed conditions. The present invention is based on this discovery.

The main object of the present invention is to propose a process for producing acrylic synthetic fibers having anti-pilling properties and possessing a dyeability which causes no trouble in practical use.

Another main object of the invention is to find a technical means for producing anti-pilling acrylic synthetic fibers which are excellent in industrial usefulness.

Other objects of the invention will become apparent from the following description of the specification.

These objects of the present invention are attained by the unitary combination of the following process requirements (1) to (6):

(1) using an acrylic polymer containing combined therewith at least 85 weight % acrylonitrile, (2) wet-spinning a spinning solution prepared from said polymer and stretching the thus-obtained spun fibers at a stretching ratio of 4 to 9 times, (3) while adjusting the internal water content of the water-swollen gel fibers after stretching to 50 to 130% based on the dry weight of the fiber-forming polymer, (4) drying-compacting the stretched fibers in a tension-free state, (5) subjecting the fibers to a secondary stretching step at a stretching ratio of 1.1 to 2.0 times in a wet-heat atmosphere above 100° C., and (6) subjecting the fibers to a relaxing heat treatment at a temperature below 120° C.

The acrylic synthetic fibers obtained according to the process of the present invention are furnished with excellent anti-pilling properties corresponding to their suitable strength and elongation (which are directed to a lower strength and a lower elongation in comparison with those of the prior art), and cause no trouble in dyeing because of their moderate content of acrylontrile. Thus the fibers have a very high commercial value.

DESCRIPTION OF PREFERRED EMBODIMENTS

Figure 1:
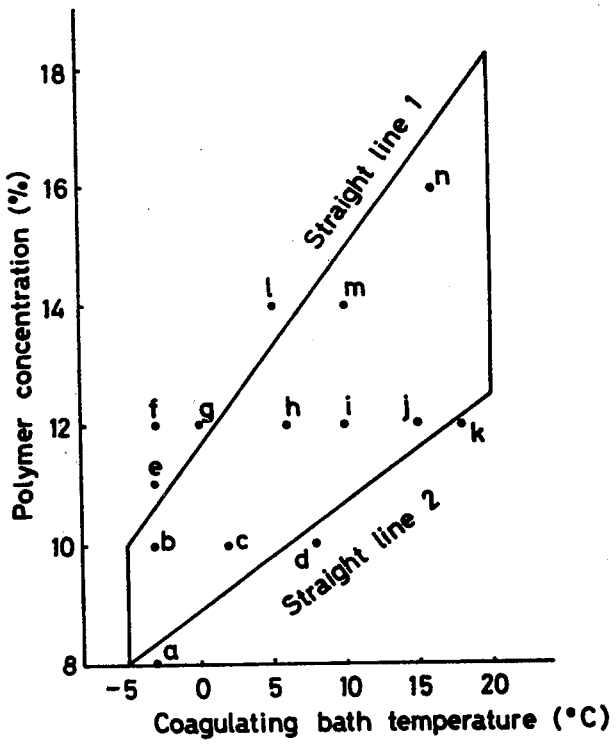

In producing acrylic synthetic fibers having such peculiar fiber properties (especially anti-pilling properties), it is important to specify the composition of the acrylic polymer, to adjust the internal water content of the water-swollen gel fibers after spinning to within a prescribed range, and to specify the process sequence of the primary stretching, drying-compacting, secondary stretching and relaxing heat treatment, and their treating conditions. More specifically, by unitary combination of the process requirements of using an acrylonitrile polymer containing combined therewith at least 85 weight % acrylonitrile; wet-spinning a spinning solution prepared from said polymer and stretching the thus-obtained spun fibers at a stretching ratio of 4–9 times; while adjusting the internal water content of the water-swollen gel fibers after stretching to 50–130% based on the dry weight of the fiber-forming polymer; drying-compacting the stretched fibers in a tension-free state; subjecting the fibers to a secondary stretching at a stretching ratio of 1.1–2.0 times in a wet-heat atmosphere above 100° C., and subjecting the fibers to a relaxing heat treatment at a temperature below 120° C., there can be obtained acrylic synthetic fibers which are of low elongation and of low strength in comparison with conventional ones, and therefore excellent in resistance to pilling, and yet not impaired in respect to dyeability. However, when any of the process requirements goes outside the preferred range or when even one of the process requirements deviate from the recommended process sequence, not only satisfactory anti-pilling properties cannot be obtained but also it becomes substantially impossible to maintain the dyeability of the final fibers in a satisfactory state.

The acrylic polymers used in the present invention include all those composed of at least 85 weight % acrylonitrile, preferably 87–93 weight % acrylonitrile, and at least one other polymerizable unsaturated vinyl compound, and can be produced by a known polymerization means, for example suspension polymerization process, emulsion polymerization process, solution polymerization process, etc. In case the content of acrylonitrile exceeds 93 weight %, it becomes difficult to heat-set the fibers in the secondary stretching step of the fiber production process which will be mentioned later, so that it becomes difficult to obtain acrylic synthetic fibers of low elongation type. In addition, difficulties are frequently encountered in dyeing (for example deep dyeing is impossible). However, even when the acrylonitrile content exceeds 93 weight %, deep dyeing can be attained by a special high-pressure, high-temperature dyeing, but such is not for general use. Among the polymerizable unsaturated vinyl compounds which are the copolymerization components for acrylonitrile, there may be mentioned acrylic acid, methacrylic acid, and their esters including methyl esters and ethyl esters; acrylamide, methacrylamide and their N-alkyl substituted compounds; vinyl esters such as vinyl acetate, vinyl propionate, etc.; vinyl halides and vinylidene halides such as vinyl chloride, vinyl bromide, vinylidene chloride, etc.; unsaturated sulfonic acids such as vinylsulfonic acid, allylsulfonic acid, methallysulfonic acid, p-styrenesulfonic acid, and their salts; and other known unsaturated compounds copolymerizable with acrylonitrile, such as styrene, methacrylonitrile, etc.

The acrylonitrile polymer thus obtained is then dissolved in a solvent to prepare a spinning solution. The solvents which dissolve the polymer include organic solvents such as dimethylformamide, dimethylacetamide, dimethyl sulfoxide, etc. and inorganic solvents such as thiocyanates, zinc chloride, nitric acid, etc. In order to attain the effect of the present invention more advantageously, it is desirable to employ inorganic solvents. The polymer concentration in the spinning solution is desirably 7–15 weight %.

The spinning solution thus prepared is thereafter spun to form fibers through a usual wet-spinning apparatus into a dilute aqueous solution of a solvent, and the fibers are subjected to cold stretching immediately after spinning, water-washing and hot stretching (such cold stretching and hot stretching altogether are called the primary stretching, and the primary stretching ratio is represented by the product of cold stretching ratio and hot stretching ratio). It is necessary to set the primary stretching ratio at 4–9 times. In case the primary stretching ratio is less than 4 times, troubles relating operation are liable to occur, for example filaments tend to wind around spinning rollers. On the other hand, when the primary stretching ratio exceeds 9 times, the fiber strength is not lowered, so that it becomes difficult to obtain low-strength acrylic synthetic fibers according to the present invention.

Furthermore, it is necessary to adjust the internal water content of the water-swollen gel fibers to 50–130% based on the dry weight of the fiber-forming polymer. In case the water content is less than 50%, it becomes difficult to obtain the acrylic fibers of low strength type to which the present invention is directed. Also, if the water content exceeds 130%, it becomes difficult to bring the fibers to a sufficiently dry state in the following drying step. This not only makes liable to cause troubles during operation but also gives rise to a partial abnormal drop in fiber strength, so that it becomes difficult to produce acrylic synthetic fibers suitable for practical use (for example fibers representing satisfactory spinnability) from the viewpoint of strength.

As regards the technical means to adjust the internal water content of the water-swollen fibers to 50–130%, the factors that can adjust said water content are, for example, polymer content in the spinning solution, coagulating bath temperature in wet-spinning, solvent concentration in the coagulating bath, temperature of water washing, temperature of the primary stretching, etc. Among these factors, the water content can be effectively adjusted by specifying the relation between polymer content in the spinning solution and coagulating bath temperature. This interrelation is explained by using FIG. 1: Firstly, an acrylonitrile polymer containing combined therewith 90 weight % acrylonitrile is dissolved in a concentrated aqueous sodium thiocyanate solution to prepare a spinning solution. The spinning solution is then spun to form fibers through a wet-spinning apparatus, with the primary stretching ratio set at 7 times. In such a situation, FIG. 1 shows the relation between polymer concentration in the spinning solution and coagulating bath temperatures in order to maintain the internal water content of the gel fibers within the prescribed range. In FIG. 1, the straight line 1 shows the case where said water content is 50%, and the straight line 2 shows the case where said water content is 130%. It goes without saying that the straight line for a water content of 70%, 90%, or 100%, for example, lies within the range limited by the straight lines 1 and 2. By setting polymer concentration and coagulating bath temperature within the area surrounded by lines:

$$y = \frac{1}{3}x + 11\frac{2}{3} \quad \text{(straight line 1)}$$
$$y = \frac{2}{11}x + 8\frac{8}{11} \quad \text{(straight line 2)}$$
$$-5 \leqq x \leqq 20 \text{ (preferably } -3 \leqq x \leqq 15)$$

wherein polymer concentration (%) is plotted as ordinate and coagulating bath temperature (°C.) as abscissa, it is possible to maintain the water content within the prescribed range.

Internal water contents of gel fibers obtained by varying the polymer concentration and coagulating bath temperature are shown in the following table.

| Polymer concentration (%) | Coagulating bath temperature (°C.) | Internal water content of gel fibers (%) | Plotted points shown in FIG. 1 |
|---|---|---|---|
| 8 | −3 | 160 | a |
| 10 | −3 | 63 | b |
| 10 | 2 | 83 | c |
| 10 | 8 | 160 | d |
| 11 | −3 | 45 | e |
| 12 | −3 | 40 | f |
| 12 | 0 | 45 | g |
| 12 | 6 | 70 | h |
| 12 | 10 | 88 | i |
| 12 | 15 | 118 | j |
| 12 | 18 | 145 | k |
| 14 | 5 | 48 | l |
| 14 | 10 | 68 | m |
| 16 | 16 | 70 | n |

After passing the primary stretching step, the gel fibers having a prescribed internal water content are then dried and compacted in a tension-free state. In this drying-compacting step, if the fibers are dried under tension, sufficiently compacted fiber structure cannot be attained and it becomes difficult to obtain fibers with high transparency (or good color development). In addition, it is concerned that a greater cost is then required for equipment and apparatus. As the drying-compacting conditions, any can be selected from the usual conditions. However, in order to attain the objects of the present invention advantageously, it is desirable to employ a wet-heat atmosphere in which the spun fibers are maintained at a dry-bulb temperature above 100° C. and a wet-bulb temperature above 50° C.

The acrylic synthetic fibers thus dried and compacted are the subjected to the secondary stretching at a stretching ratio of 1.1 to 2.0 times in a wet-heat atmosphere above 100° C. If the stretching ratio is less than 1.1 times, it provides no stretching effect, and a stretching ratio exceeding 2.0 times does not result in a lowered fiber strength. By carrying out this stretching operation in a wet-heat atmosphere above 100° C., the acrylic fibers are effectively stretched and heat-set at the same time, thus advantageously retaining the shrinkage behavior of the fibers in the following relaxing heat treatment. In this way, the acrylic synthetic fibers produced are of low strength and low elongation type, and in addition have a dyeability which is not inferior to that of conventional fibers, because of the special stretching operation providing a tensioned heat-treatment effect. In case the stretching temperature is less than 100° C., the heat setting of the fibers becomes insufficient, by which it becomes difficult to obtain acrylic synthetic fibers of low elongation type. If the stretching temperature exceeds 130° C., problems such as the discoloration of the fibers are caused. As the wet-heat atmosphere, it is possible to employ usual supersaturated or saturated steam.

The acrylic synthetic fibers that have thus undergone the secondary stretching are thereafter subjected to a relaxing heat treatment at a temperature below 120° C. and are produced into the final fibers. In case the relaxing heat treatment temperature exceeds 120° C., acrylic synthetic fibers of low elongation type are not obtained.

By specifying the composition of the acrylic polymer, the primary stretching ratio, the internal water content of the gel fibers after the primary stretching, the drying-compacting condition, the stretching ratio and stretching temperature in the secondary stretching and the relaxing heat treatment temperature and by employing these specified factors in combination, it has been found that there can be obtained acrylic fibers having a resistance to pilling far superior to that of the conventional ones and having a dyeing level not inferior to the usual ones.

An example of the present invention will be described hereunder, but it is to be understood that the invention is by no means limited for its scope by the example, in which all parts and percentages are by weight unless otherwise indicated.

EXAMPLE 1

Acrylic synthetic fibers, 2 deniers in single-filament fineness, were produced on the basis of the production conditions (acrylic polymer composition, polymer concentration in the spinning solution, coagulating bath temperature, primary stretching ratio, stretching ratio and stretching temperature in the secondary stretching and relaxing heat treatment temperature) described in Table 1. The drying-compacting step was carried out in a tension-free state in an atmosphere of a dry-bulb temperature of 120° C. and a wet-bulb temperature of 60° C. The results of measurement of the strength and elongation of the acrylic synthetic fibers are shown in Table 1.

The synthetic fibers thus obtained were formed into a spun yarn in the usual way and the spun yarn was knitted to form an acrylic knit cloth, and it was evaluated for its anti-pilling properties. The results are also shown in Table 1.

The measurement of strength and elongation and the evaluation of anti-pilling properties as well as the water content in the interior of the gel fibers were carried out as follows:

(1) Measurement of single-filament strength and elongation was made in accordance with JIS L-1075 (1966).

(2) Evaluation of anti-pilling properties (pilling grades)

The test specimens are measured for the pilling grades on an ICI Pilling Tester. A test piece of about 10×12 cm is wrapped on a rubber tube, 2.5 cm in diameter and 15 cm in length, in a tension-free state. The margins are sewed together with cotton thread so that they should not overlap on each other, and both ends are fixed with cellophane tape. A set of four test pieces are placed in a treating box lined with cork, and the box is rotated at a constant speed of 60 rpm for 5 hours. Thereafter, the test pieces are removed from the box and the state of the occurrence of pills is judged by sight in accordance with the following criteria:

Grade 5: No substantial pill occurrence and change in appearance are observed.

Grade 4: Slight pill occurrence and change in appearance are observed.

Grade 3: Medium pill occurrence and change in appearance are observed.

Grade 2: Considerable pill occurrence and change in appearance are observed.

Grade 1: Extremely remarkable pill occurrence and change in appearance are observed.

In this evaluation method, a specimen of Grade 4 or higher is judged as good in anti-pilling properties.

(3) Internal water content of the gel fibers

The acrylic gel fibers are put into a centrifuge and are dehydrated therein at 3000 rpm for two minutes. The water content of the fibers after this treatment is measured by dry weight method to obtain remaining water content (%), and a value (10%) which is considered to have no relation with the internal water content to be obtained, is substracted from the remaining water content. The thus-obtained value is taken as the internal water content of the gel fibers.

the fibers obtained by this method were 3.80 g/d and 37.8%, respectively. Said acrylic synthetic fibers were knitted in the usual way to form a knitted fabric and the fabric was evaluated for its anti-pilling properties. The anti-pilling grade was grade 3 and the fabric did not have a high commercial value.

4. Brief Explanation of the Drawing

FIG. 1 shows the relation between polymer concentration in the spinning solution and coagulating bath temperature to maintain the internal water content of the water-swollen gel fibers after the primary stretching within the specified range according to the present invention.

What is claimed is:

1. A process for producing acrylic synthetic fibers having anti-pilling properties characterized by obtaining said acrylic synthetic fibers by unitary combination of the following process requirements (1) to (6) of:

(1) using an acrylic polymer containing combined therewith at least 85 weight % acrylonitrile, (2) wet-spinning a spinning solution prepared from said polymer and stretching the thus-obtained spun fibers at a stretching ratio of 4–9 times, (3) while adjusting the internal water content of the water-swollen gel fibers after stretching to 50–130% based on the dry weight of the fiber-forming polymer, (4) drying-compacting the stretched fibers in a tension-free state, (5) subjecting the fibers to a secondary stretching step at a stretching ratio of 1.1–2.0 times in a wet-heat atmosphere above 100° C., and (6) subjecting the fibers to a relaxing heat treatment at a temperature below 120° C.

2. The process for producing acrylic synthetic fibers as claimed in claim 1 wherein an acrylic polymer composed of 87–93 weight % acrylonitrile is used.

3. The process for producing acrylic synthetic fibers as claimed in claim 1 wherein a spinning solution of the acrylic polymer dissolved in an inorganic solvent is used.

4. The process for producing acrylic synthetic fibers as claimed in claim 1 wherein the internal water content of the water-swollen gel fibers is adjusted to 50–130%

Table 1

| Sample no. | Acrylonitrile content (%) in polymer | Polymer concentration (%) in spinning solutin | Coagulating bath temperature (°C.) | Internal water content (%) of gel fibers after the primary stretching | Primary stretching ratio | Secondary stretching Ratio | Secondary stretching Temp. (°C.) | Relaxing heat treatment temp (°C.) | Evaluation of fiber properties Strength (g/d) | Elongation (%) | Pilling grade | Dyeability* |
|---|---|---|---|---|---|---|---|---|---|---|---|---|
| A | 80 | 12 | +6.0 | 71 | 7 | 1.4 | 125 | 105 | 2.9 | 45 | 2 | Δ |
| B | 90 | 12 | +6.0 | 70 | 7 | 1.4 | 125 | 110 | 2.9 | 29 | 4–5 | ◎ |
| C | 95 | 12 | +6.0 | 70 | 7 | 1.4 | 125 | 115 | 3.1 | 26 | 4–5 | X |
| D | 90 | 10 | −3.0 | 63 | 8 | 1.4 | 130 | 118 | 3.2 | 30 | 4–5 | ◎ |
| E | 90 | 12 | −3.0 | 40 | 7 | 1.4 | 130 | 115 | 4.0 | 30 | 3 | Δ |
| F | 90 | 12 | +15.0 | 118 | 8 | 1.5 | 120 | 115 | 3.2 | 29 | 4–5 | ◎ |
| G | 90 | 12 | +10.0 | 88 | 10 | 1.3 | 125 | 115 | 4.2 | 29 | 3 | ○ |
| H | 90 | 10 | +2.0 | 83 | 6 | 1.6 | 125 | 115 | 3.0 | 30 | 4–5 | ◎ |
| I | 90 | 12 | +4.0 | 80 | 6 | 2.2 | 125 | 115 | 4.1 | 27 | 3 | Δ |
| J | 90 | 12 | +8.0 | 78 | 7 | 1.4 | 95 | 110 | 2.9 | 38 | 3 | Δ |
| K | 90 | 12 | +8.0 | 78 | 7 | 1.4 | 115 | 110 | 3.0 | 31 | 4–5 | ◎ |
| L | 90 | 12 | +8.0 | 78 | 7 | 1.4 | 125 | 124 | 3.0 | 41 | 2 | ◎ |

*In comparison with ordinary acrylic synthetic fibers,
◎ the fibers have the same dyeing level,
Δ a lower dyeing level,
almost the same but a little lower dyeing level,
X considerably lower From the results shown in Table 1, it is clearly understood that the acrylic synthetic fibers produced employing, in unitary combination, the process requirements according to the present invention (Samples B, D, F, H and K) have a suitable fiber strength and elongation satisfactory as fibers of low strength and low elongation type and have excellent anti-pilling properties corresponding thereto, and the dyeability is not impaired.

Comparative Example

A spinning solution of a polymer concentration of 10% was prepared, using the same acrylic polymer as used in Sample No. D of Example 1. The spinning solution was spun through an ordinary wet-spinning apparatus to form fibers. The fibers were then subjected to the primary stretching at the ratio of 8 times and were dried and compacted under the condition of a dry-bulb temperature of 120° C. and a wet-bulb temperature of 60° C. Thereafter, without the secondary stretching, the fibers were immediately subjected to a relaxing heat treatment in saturated steam at 105° C. and were finally produced to form acrylic synthetic fibers of a single-filament fineness of 2 deniers. The fiber strength and elongation of while maintaining the relation between polymer concentration (y) in the spinning solution and coagulating bath temperature (x) specified in the following formulae:

$$y \leqq \frac{1}{3}x + 11\frac{2}{3} \quad \text{(A)}$$

-continued $$y \geqq \frac{2}{11}x + 8\frac{10}{11} \quad \text{(B)}$$

$$-5 \leqq x \leqq 20 \quad \text{(C)}$$

5. The process for producing acrylic synthetic fibers as claimed in claim 1 wherein the drying-compacting step of the fibers is carried out in a wet-heat atmosphere maintained at a wet-bulb temperature above 50° C. and a dry-bulb temperature above 100° C.

* * * * *